US007322446B2

(12) United States Patent
Terry et al.

(10) Patent No.: US 7,322,446 B2
(45) Date of Patent: Jan. 29, 2008

(54) ELEVATOR CALL ASSIGNMENT INDICATIONS FOR MULTIPLE ELEVATORS IN EACH OF A PLURALITY OF ELEVATOR HOISTWAYS

(75) Inventors: Harold Terry, Avon, CT (US); Frank M. Sansevero, Glastonbury, CT (US); Theresa Christy, West Hartford, CT (US); Arthur Hsu, South Glastonbury, CT (US)

(73) Assignee: Otis Elevator Company, Farmington, CT (US)

( * ) Notice: Subject to any disclaimer, the term of this patent is extended or adjusted under 35 U.S.C. 154(b) by 597 days.

(21) Appl. No.: 10/981,834

(22) Filed: Nov. 5, 2004

(65) Prior Publication Data

US 2006/0096811 A1 May 11, 2006

(51) Int. Cl.
*B66B 1/34* (2006.01)

(52) U.S. Cl. ..... 187/391; 187/249

(58) Field of Classification Search ..... 187/247, 187/249, 380–388, 391–396
See application file for complete search history.

(56) References Cited

U.S. PATENT DOCUMENTS

| | | | | |
|---|---|---|---|---|
| 4,149,614 | A * | 4/1979 | Mandel et al. | 187/397 |
| 4,248,327 | A * | 2/1981 | Mandel et al. | 187/393 |
| 4,972,926 | A * | 11/1990 | Tsuji et al. | 187/380 |
| 4,989,694 | A * | 2/1991 | Ueshima et al. | 187/380 |
| 5,419,414 | A * | 5/1995 | Sakita | 187/391 |
| 2007/0131484 | A1* | 6/2007 | Hikita | 187/249 |

* cited by examiner

*Primary Examiner*—Jonathan Salata

(57) ABSTRACT

A plurality of hoistways (11, 12) in a building serving a plurality of floors utilizes destination call entry panels (22, 22A) having buttons (23) with which passengers can enter destination call requests. A display (26, 26*a*) adjacent the request buttons provides an indication of the car that is assigned to answer the passenger's request by a controller (27), which indication is also presented on illuminatable signs (16-19, 40, 41), utilizing either colors, letters or other easily identifiable and rememberable indications. As the car assigned to the call approaches the landing upon which the call was made, an illuminatable sign, adjacent the hoistway of the assigned car, will present the same color or indicia as was presented to the passenger upon entering the passenger's desired destination; the controller does not announce approaching cars that are not assigned a call at that landing.

2 Claims, 3 Drawing Sheets

ELEVATOR CALL ASSIGNMENT INDICATIONS FOR MULTIPLE ELEVATORS IN EACH OF A PLURALITY OF ELEVATOR HOISTWAYS

TECHNICAL FIELD

This invention relates to identifying not only a hoistway containing an elevator which will answer a registered destination call, but also identifying a selected one of a plurality of elevators in the hoistway to which the destination call has been assigned.

BACKGROUND ART

The use of multiple elevator cars in a single elevator hoistway has always posed problems of assignment of cars to calls as well as identifying any particular car that has been assigned to answer a call. In early double-deck elevators, persons desiring to reach an odd floor during up peak traffic would have to enter at an odd floor lobby; similarly for even floors. During down peak, persons entering from an odd or even floor were similarly carried to an odd or even lobby, respectively, near the street level. During off-peak, the dispatching system attempted to answer two calls (either car calls or hall calls) at the same time, if possible, and otherwise simply assigned calls to either the upper or lower deck and delivered any passengers to whichever floors they designated with car calls.

More recently, signage has been provided to indicate to passengers the next stop of an arriving car so that passengers can either enter it or not. This of course does not present adequate service to waiting passengers.

The concept of multiple elevator cars (such as three) within the same hoistway is now known. However, the ability to adequately inform a passenger which arriving car that passenger should enter in order to reach the passenger's destination registered by a call has not been provided adequately.

DISCLOSURE OF INVENTION

Objects of the invention include: elevator signage which indicates to passengers the particular car of a number of elevator cars in a plurality of hoistways which has been assigned to take the passenger to the desired destination floor; elevator service which provides an indication of the selected elevator car of plurality of cars in each of a plurality of hoistways in an easily identified and easily remembered fashion; improved elevator service; and improved multiple hoistway, multiple car per hoistway elevator service.

According to the present invention, an elevator system having a plurality of elevator cars operating within a plurality of different hoistways provides easily identifiable and easily rememberable indications to passengers identifying the particular car and hoistway which is to provide service to a registered destination floor; cars not responding to a call are not announced as they approach a floor.

According to the invention further, the signage may designate the individual cars by unique colors disposed adjacent the entrance to the corresponding hoistway, or by letters or other symbols adjacent the hoistway, which colors, letters or symbols match corresponding colors, letters or symbols indicated to the passenger on a call entry panel display at the time the destination call is entered by the passenger. Thus, matching of a color, letter or other symbol is easily achieved to identify the arrival of the car that has previously been assigned to serve that passenger's needs.

Other objects, features and advantages of the present invention will become more apparent in the light of the following detailed description of exemplary embodiments thereof, as illustrated in the accompanying drawing.

MODE(S) FOR CARRYING OUT THE INVENTION

Figure 1:
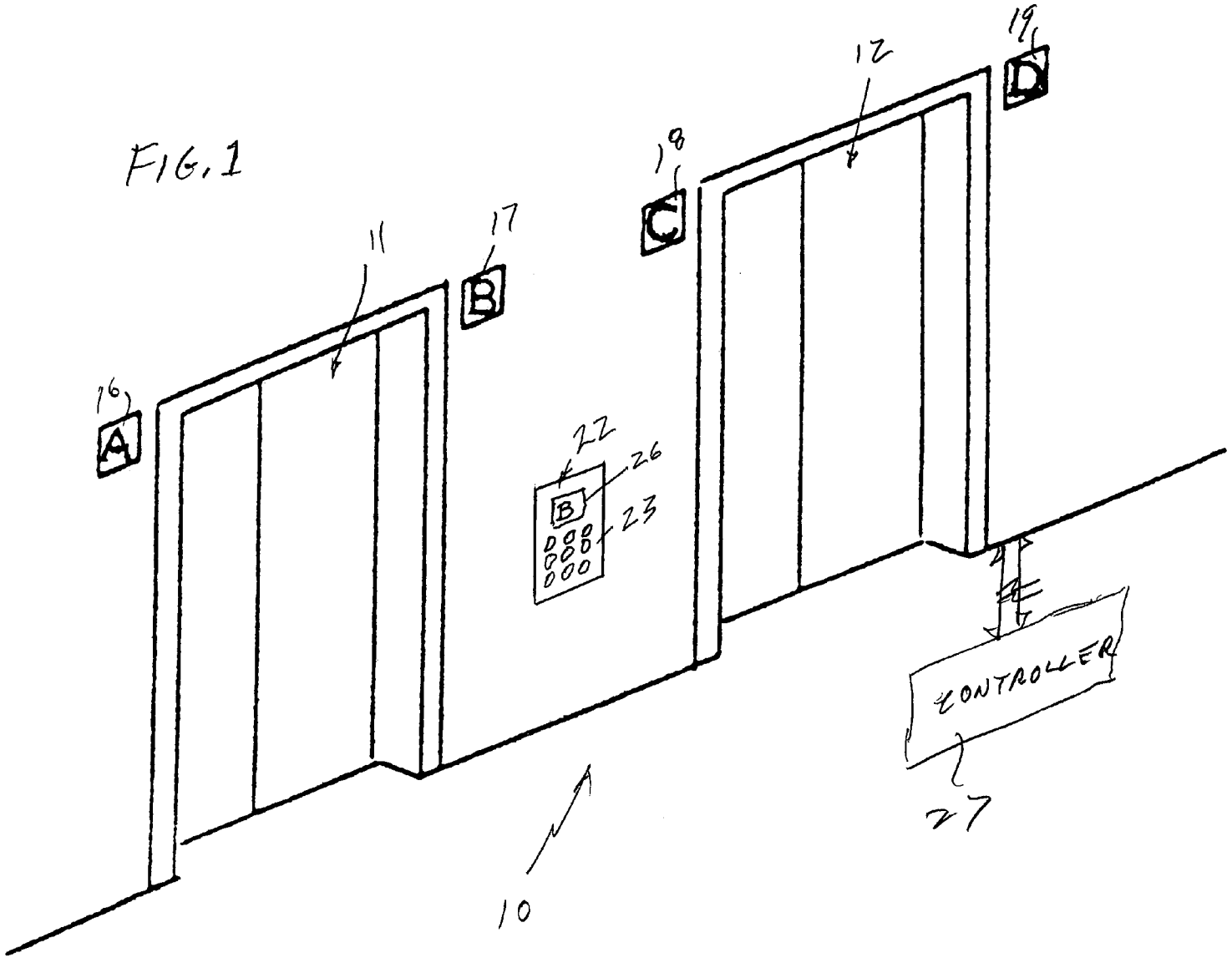
FIG. 1 is a simplified, partial perspective view of an elevator lobby with call assignment signage according to the invention, employing letters.

Referring to FIG. 1, an illustrative elevator lobby 10 on a particular floor, herein referred to as floor F, in a building having a plurality of hoistways 11, 12 (herein, for instance, two hoistways), serving a plurality of floors (herein, for instance, ten floors), with more than one elevator car in each hoistway. In the example shown in FIG. 1, the cars in hoistway 11 are designated A and B, and the cars in hoistway 12 are designated C and D. The letter designations appear on the illuminatable signs 16-19, utilized in a manner described hereinafter.

In order to enter requests for elevator service, a call entry station 22 includes, in this example, keys 23 indicative of all of the nine other floors in the building which may be pressed to enter a call for the passengers' desired destination floor, in a conventional way. Alternatively, the call entry panel 22 may have other call designating buttons, such as a 10-key pad.

The call entry station 22 also includes a display 26 which can present any of the letters A-D to indicate to the passenger the particular car which has been assigned to the call by a controller 27. In this example, call assignments are near instantaneous such that other call entries are not made between the time that one passenger selects a destination floor and the identity (A-D) of the car that is assigned to answer that call is indicated on the display 26.

The operation in the controller 27 is relatively simple and may be carried out with a variety of software routines in any readily available computer. Other necessary steps such as recognizing that the call has been assigned and that the call has been answered, initiating and resetting functions, and providing other proper management of the call assignment and illumination processes are conventional and are omitted herein for clarity.

Figure 2:
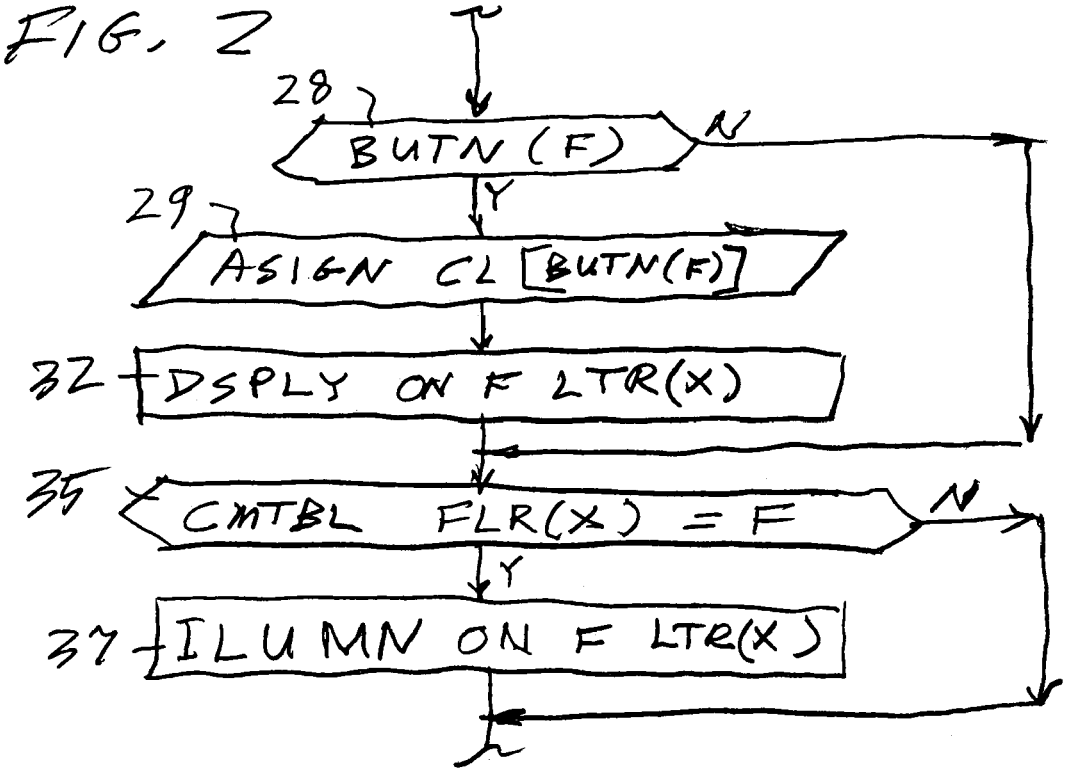
FIG. 2 is a simplified function diagram of a method for informing passengers of the arrival of a car assigned to the passengers' call, employing letters.

An example of functions which may be performed to employ the invention as illustrated in FIG. 1, is shown in FIG. 2. Therein, a first test 28 determines if a button 23 has been pressed on floor F. If so, a routine 29 will assign the call designated by the button pressed on floor F to one of the cars A-D. In this example, that car is designated X. A step 32 will cause the display 26 on floor F to present the letter (A-D) of the assigned car (X). If no button has been pressed on floor F, the routine 29 and the step 32 will be bypassed by a negative result of test 28.

A test 35 determines if the committable floor of the assigned car X is floor F, and if so, a step 37 will cause the letter A-D of the assigned car, X, to be illuminated on the related sign 16-19. If test 35 is negative, step 37 is omitted.

Figure 3:
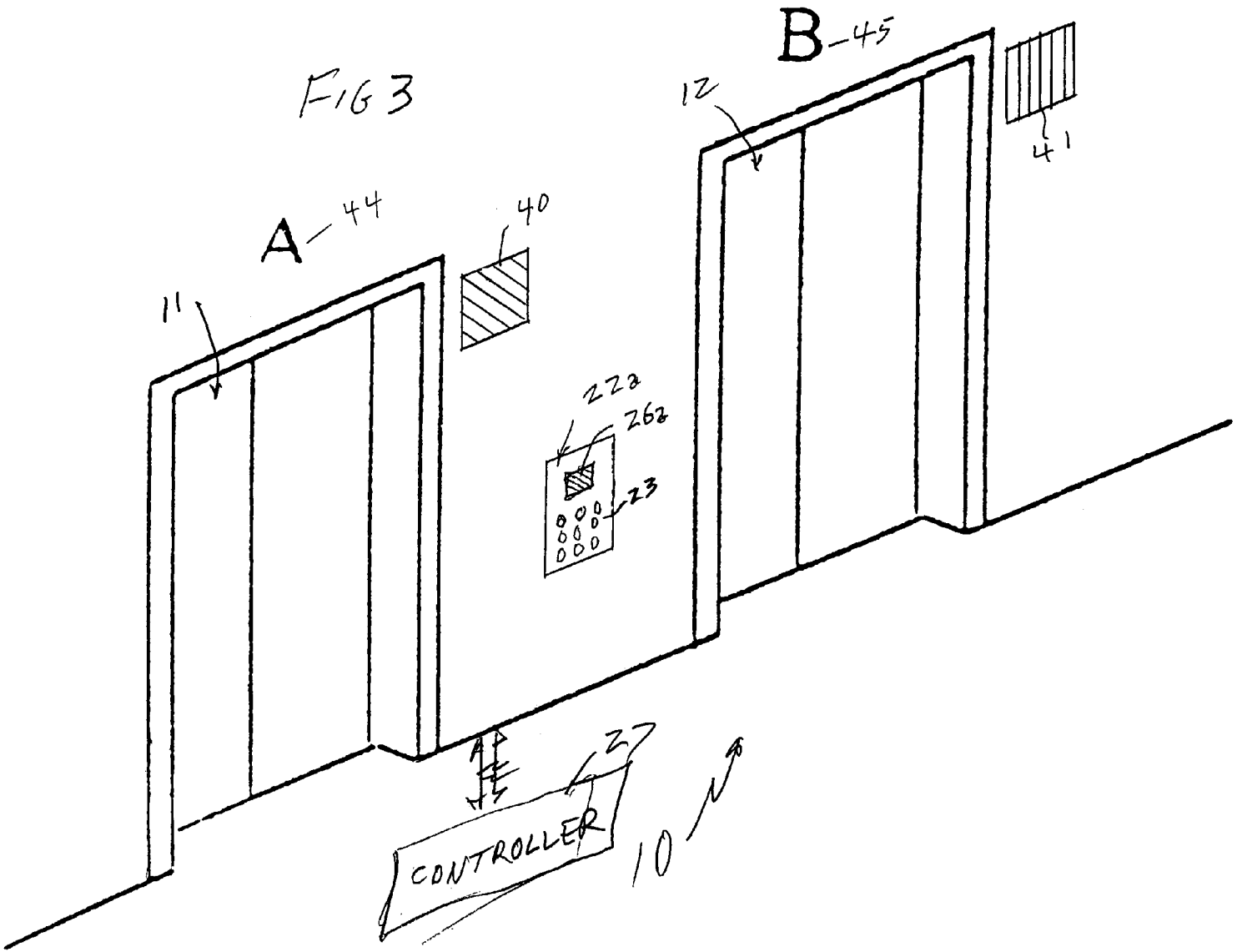
FIG. 3 is a simplified, partial perspective view of an elevator lobby with call assignment signage according to the invention, employing color.

Referring to FIG. 3, in a second embodiment of the invention the display 26*a* of the call entry panel 22*a* displays a selected one of four (in this example) distinct colors. When the assigned car arrives at either of the hoistways 11, 12, a corresponding illuminatable sign 40, 41 will display the same color as was displayed at the call entry panel when the call was entered. The display 26*a* and the sign 40 are lined for the color green; the sign 41 is lined for the color red. In this particular example, designation of the hoistways themselves (such as with the letters A and B (44, 45), is not necessary and may be omitted.

Figure 4:
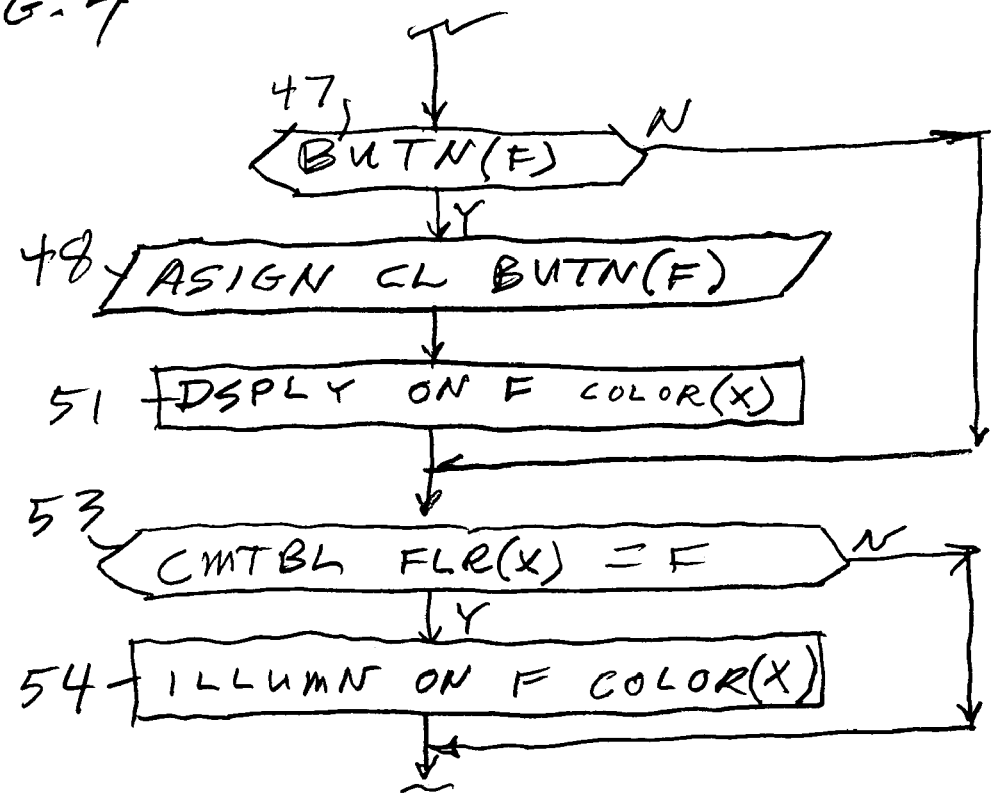
FIG. 4 is a simplified function diagram of a method for informing passengers of the arrival of a car assigned to the passengers' call, employing color.

FIG. 4 illustrates functions which may be performed in implementing the invention as illustrated in FIG. 3. In FIG. 4, a first test determines if a button 23 has been pressed on floor F. If so, a subroutine 48 assigns the call for the destination floor indicated by the depressed button to a car, X. Then, a step 51 presents on the display 26A the color of the assigned car, X. If no button were depressed on floor F, a negative result of test 47 causes the subroutine 48 and step 51 to be bypassed.

A test 53 determines if the committable floor of the assigned car, X, is floor F; if so, a step 54 causes a corresponding one of the signs 40, 41 to be illuminated in the color of the assigned car, X. The one of the signs 40, 41 will be selected based upon the hoistway 11, 12 within which car X is serving passengers.

The controller 27 does not cause illumination of any signs next to a hoistway on a floor when a car, not assigned to answer a call on that floor, approaches that floor in that hoistway. That is a paramount feature of the invention.

Instead of letters, the embodiment of FIG. 1 might use numbers (such as 1-4), or other symbols. The embodiments herein illustrate only two hoistways with two elevators each in a ten story building. However, the invention may of course be used in buildings of other sizes, with more hoistways, and with more elevators in each hoistway. In such a case, in the embodiment of FIG. 1, there may be two letters on one side of each of the hoistways 11, 12, or two letters on each side of each hoistway 11, 12 to support three or four elevators in each hoistway, respectively. Similarly, more of the illuminatable signs 40, 41 may be utilized if more colors than are conveniently displayable on each are required, due to more elevators in each hoistway 11, 12.

The nature of the invention is that the passenger, upon entering a destination call, receive information at the call input station 22, 22A which information will be displayed adjacent the correct hoistway to announce the approach of the car assigned to carry the passenger to that desired destination that has been entered as a request by means of the buttons 23; and cars which are not assigned to calls entered on a particular floor are not announced at that floor.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. An elevator system having a plurality of hoistways serving a plurality of floors in a building, each hoistway having a plurality of elevator cars moveable within a corresponding hoistway to serve passengers, comprising:

a call entry panel on each floor, said call entry panel having a plurality of buttons with which passengers can enter requests for service to desired destination floors, each said call entry panel having a display to present a unique one of a plurality of indicia to the passenger indicative of the car which has been assigned to service the passenger's call, said indicia selected from color, letters and symbols other than letters;

a controller for assigning each request for service to one of said cars; and a plurality of illuminatable signs, there being at least one of said illuminatable signs adjacent each of said hoistways, each of said illuminatable signs capable of displaying any indicium presented by said display on said call entry panel;

characterized by:

said controller causing, as a car assigned to respond to a request for service approaches the floor on which said request for service was entered, said unique indicium to be displayed in one of said signs adjacent to the one of said hoistways in which said assigned car is moving, said controller not causing illumination of signs on any floor when a car approaches that is not assigned to respond to a request for service on said any floor.

2. A method of correlating destination calls in an elevator system having a plurality of hoistways serving a plurality of floors in a building, each hoistway having a plurality of elevator cars moveable within a corresponding hoistway to serve passengers, each floor having a call entry panel, said call entry panels each having a plurality of buttons with which passengers can enter requests for service to a desired destination floor, each call entry panel having a display to present to the passenger a unique one of a plurality of indicia indicative of the car which has been assigned to service the passenger's call, said indicia selected from color, letters and symbols other than letters, and at least one illuminatable sign adjacent to each of said hoistways, each of said illuminatable signs capable of displaying any indicium presented by said display on said call entry panel, said method comprising:

assigning each request for service to one of said cars;

characterized by:

as a car assigned to respond to a request for service approaches the floor on which said request for service was entered, causing to be displayed in one of said signs adjacent to the one of said hoistways in which said assigned car is moving, the one of said indicia presented on said call entry panel in response to entry of said request for service, said controller not causing illumination of signs on any floor in response to approach of a car that is not assigned to respond to a request for service on said any floor.

* * * * *